US006951055B1

(12) United States Patent
Collins

(10) Patent No.: US 6,951,055 B1
(45) Date of Patent: Oct. 4, 2005

(54) FOLDING UTILITY KNIFE

(76) Inventor: Walter W. Collins, P.O. Box 100, North, SC (US) 29112

( * ) Notice: Subject to any disclaimer, the term of this patent is extended or adjusted under 35 U.S.C. 154(b) by 0 days.

(21) Appl. No.: 10/877,901

(22) Filed: Jun. 25, 2004

(51) Int. Cl.[7] ..... B26B 1/08
(52) U.S. Cl. ..... 30/162; 30/125; 30/335
(58) Field of Search ..... 30/155, 156, 157, 30/161, 162, 125, 329, 330, 331, 333, 337, 30/339, 340

(56) References Cited

U.S. PATENT DOCUMENTS

| | | | | |
|---|---|---|---|---|
| 698,080 | A | 4/1902 | Treas | |
| 1,603,914 | A | 1/1926 | Hermann | |
| 2,134,973 | A * | 11/1938 | Harwell | 30/156 |
| 2,651,839 | A | 9/1953 | Folland | |
| 2,980,996 | A * | 4/1961 | Beran | 30/157 |
| 3,593,417 | A | 7/1971 | West et al. | |
| 3,872,591 | A | 3/1975 | Quenot | |
| 3,965,575 | A | 6/1976 | Stunger | |
| 4,451,982 | A * | 6/1984 | Collins | 30/161 |
| 5,095,624 | A * | 3/1992 | Ennis | 30/161 |
| 5,386,632 | A * | 2/1995 | Schmidt | 30/125 |
| 5,425,175 | A * | 6/1995 | Rogers | 30/161 |
| 5,495,670 | A * | 3/1996 | Quinn | 30/162 |
| 5,661,908 | A | 9/1997 | Chen | |
| 5,769,094 | A | 6/1998 | Jenkins, Jr. et al. | |
| D397,282 | S | 8/1998 | Derkatz | |
| 5,815,927 | A | 10/1998 | Collins | |
| 5,819,414 | A | 10/1998 | Marifone | |
| 6,145,202 | A | 11/2000 | Onion | |
| 6,354,007 | B1 | 3/2002 | Scarla | |
| 6,397,477 | B1 | 6/2002 | Collins | |
| 6,574,868 | B1 * | 6/2003 | Overholt | 30/155 |
| 6,684,510 | B1 * | 2/2004 | Collins | 30/161 |
| 6,688,003 | B2 | 2/2004 | Scarla | |
| 2003/0070299 | A1 | 4/2003 | Frazer | |
| 2003/0213134 | A1 | 11/2003 | Sakal | |
| 2004/0107580 | A1 * | 6/2004 | Ping | 30/160 |
| 2004/0226175 | A1 * | 11/2004 | Ping | 30/340 |

OTHER PUBLICATIONS

Sheffield Folding Lockback Utility Knife, internet web site: http://store.autotoolexpress.com/foloutkn.html.

* cited by examiner

*Primary Examiner*—Hwei-Siu Payer
(74) *Attorney, Agent, or Firm*—Leatherwood Walker Todd & Mann, P.C.; Thomas W. Epting

(57) ABSTRACT

A utility knife for receipt of a blade and including a handle and a blade carrier pivotally connected to the handle. A threaded fastener fastens a blade retainer to the blade carrier, and the threaded fastener is preferably configured for engagement by the user's hand to move the blade carrier between the retracted position and the extended position. A locking member automatically locks the blade carrier in an extended position upon the blade carrier being moved to the extended position. An actuator moves the locking member against the force of a spring from the locking position to the unlocking position, the actuator extending from the first side of the handle to the second side of the handle. A storage compartment is configured for receipt of plurality of blades, and a closure member allows selective access to such blades.

14 Claims, 3 Drawing Sheets

FOLDING UTILITY KNIFE

BACKGROUND OF THE INVENTION

This invention relates generally to a folding utility knife having a replaceable blade or cutting member.

Utility knives having replaceable blades are used in a variety of applications, such as in carpentry, floor covering installations, hobby work, mechanical work, electrical work, etc.

One known type of such utility knife includes a blade which is moveable longitudinally with respect to a handle through use of a slide button. The handle includes a storage area for replacement blades, such handle being formed of two handle halves screwed to one another. The blade storage area is accessed by unscrewing the halves of the handle to expose the storage area.

Knives having replaceable blades have been patented. For example, U.S. Pat. No. 5,769,094, issued to Collins, the present applicant, discloses a folding knife with a blade carrier for carrying different blades. U.S. Pat. Nos. 6,688,003 B2 and 6,354,007 B1, both issued to Scarla, disclose a utility knife having a neck pivotally connected to a handle, and a blade mounted in the neck.

SUMMARY OF THE INVENTION

Generally, the present invention includes a utility knife for receipt of a blade and including a handle and a blade carrier pivotally connected to the handle for pivoting between a retracted position adjacent the handle and an extended position extending outwardly from the handle. The blade is carried in the blade carrier, and the blade carrier defines a receptacle configured for readily removable receipt of the blade.

A blade retainer is provided which is configured for extending adjacent the blade and for retaining the blade in the receptacle. A threaded fastener selectively fastens the blade retainer to the blade carrier, and the threaded fastener is preferably configured, upon a user holding the handle in the user's hand, for engagement by at least one of the user's digits of the user's hand, i.e., thumb and/or or fingers, to move the blade carrier between the retracted position and the extended position.

More specifically, the present invention includes a locking member carried by the handle for movement between a locking position and an unlocking position, the locking member being configured for automatically moving to the locking position for locking the blade carrier in the extended position upon the blade carrier being moved to the extended position.

A spring or other resilient member or means may be provided and configured for forcing the locking member towards the locking position, and an actuator is connected to the locking member and configured for moving the locking member against the force of the spring from the locking position to the unlocking position, the actuator, in one preferred embodiment, extending outwardly from the first exterior side of the handle and the second exterior side of the handle.

Also, in one preferred embodiment of the present invention, the handle defines a storage compartment configured for receipt of a plurality of blades. A closure member is provided and configured for retaining blades in the storage compartment, and the closure member is movable to allow selective access to the blades.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
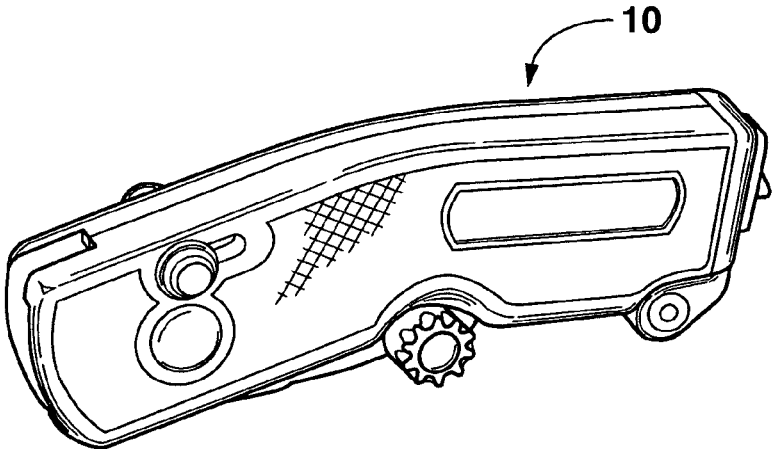
FIG. 1 is a perspective view of a folding utility knife constructed in accordance with the present invention, with the blade, or cutting implement, being in the retracted, or closed, position.

The accompanying drawings and the description which follows set forth this invention in its preferred embodiment. However, it is contemplated that persons generally familiar with utility knives and folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the folding utility knife of the present invention is indicated generally in the figures by reference characters 10.

The folding utility knife 10 of the present invention is illustrated with its blade, or cutting implement, generally 12, in a retracted, or closed, configuration. It is to be understood that such blade or cutting implement 12 could be in a variety of different shapes and configurations, rather than the generally trapezoidal shaped-blade depicted in the drawings. For example, the blade could have a serrated cutting edge, one or more hook-shaped portions provided with the cutting edge, or it could be a combination blade having a hook-shaped cutting portion and also a straight and/or serrated cutting portion. While these additional blade versions are not illustrated, they could be used in the folding utility knife 10 of the present invention, if desired, and/or depending on the particular application for which knife 10 is to be used. Furthermore, as used herein, the term "blade" shall refer not only to the blades illustrated in the drawings, but to cutting implements, tool implements, and blades of other shapes and configurations generally, including, but not limited to the foregoing blades described above.

Figure 2:
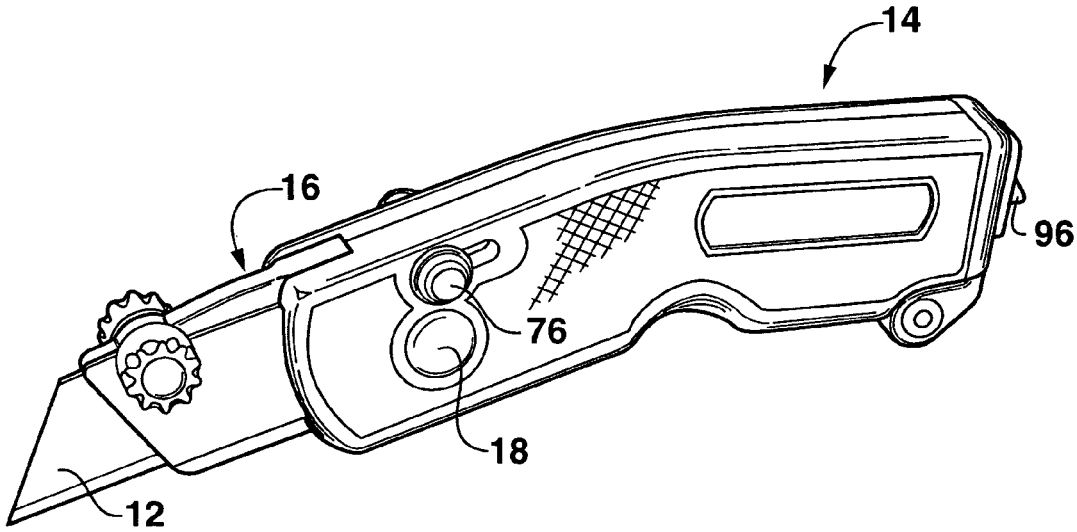
FIG. 2 is a perspective view of a folded utility knife constructed in accordance with the present invention, showing the cutting implement in the open, or extended, position.
Figure 5:
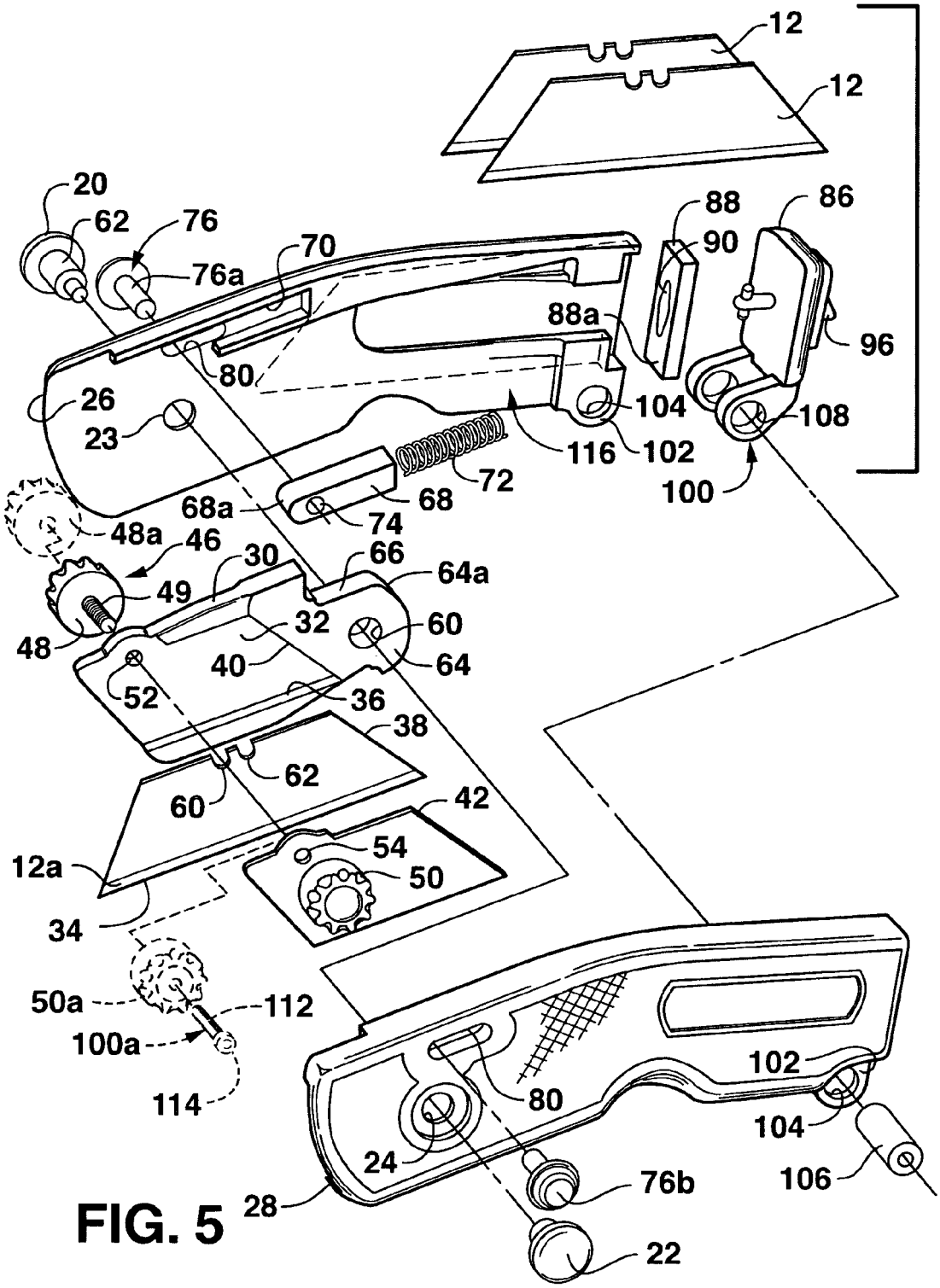
FIG. 5 is an exploded view of a folding utility knife constructed in accordance with the present invention.

FIG. 2 illustrates blade 12 as shown in the extended, or opened, position, extending outwardly from a handle, generally 14. A blade carrier, generally 16, is provided for carrying blade 12, and blade carrier 16 is pivotally connected by pivot, generally 18, to handle 14 for pivoting between the open and closed positions. As shown in FIG. 5, male and female pivotal connectors 20, 22, respectively, provide such pivotal connection of blade carrier 16 to handle 14, and such pivotal connectors pass through openings 23, 24, in handle members 26, 28 of handle 14, respectively.

Figure 3:
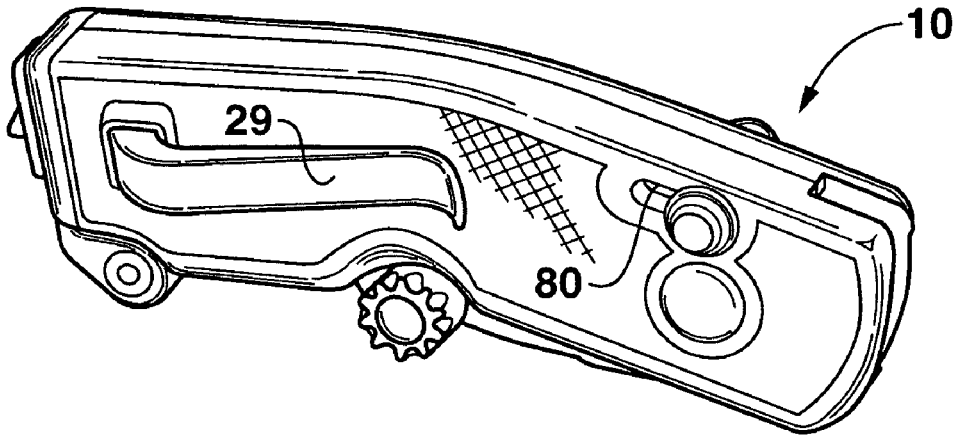
FIG. 3 is a perspective view, from the rear, of a folding utility knife constructed in accordance with the present invention.

FIG. 3 illustrates folding utility knife 10 from the backside, wherein a clip 29 is attached to handle 14. Clip 29 facilitates carrying of knife 10 in a user's pocket, back pack, tool pouch, etc.

Blade carrier 16, as shown in FIG. 5, includes a blade receiver 30 having a blade receptacle 32. Blade 12 is received in blade receptacle 32, and a portion of the lower edge 34 of blade 12 may rest on a ledge 36 provided at the lower portion of receptacle 32. The rearward edge 38 of blade 12 may also engage with a wall portion 40 of receptacle 32. A blade retainer panel 42 is placed adjacent blade 12 for holding blade 12 within receptacle 32. A combination threaded fastener, generally 46 is provided for selectively fixing retainer 42 to blade carrier 16 and for acting as an engagement portion, i.e., "thumb stud," to facilitate movement of blade carrier 16 between the open and closed positions with the thumb and/or fingers of the user. This allows for one-handed pivoting of the blade carrier 16 from the retracted position to the extended position.

Combination 46 includes a threaded male portion 48, having threaded shaft 49 and a threaded female portion 50, or knob, 50. Both portions 48, 50 preferable include a profiled surface, such as knurled or grooved texture, to facilitate the gaining of purchase by the user's thumb and/or fingers for tightening combination 46, or in loosening combination 46, when installing or removing a blade 12, as the case may be. The profiled surface texture of combination 46 also facilitates engagement of the users thumb and/or one or more of the user's fingers when moving the blade carrier 16 between the open and closed positions, even if the user is wearing gloves.

Threaded shaft 49 passes through an opening 52 and an opening 54 in blade receiver 30, and blade retainer 42, respectively. Note that the threaded shaft portion 49 of portion 48 is configured to extend through either of the two slots 60, 62 found in certain conventional utility blades 12. It is to be understood, however, that, as noted above, blades having a profile other than that of blade 12, including slots, holes, recesses, etc. other than slot 60, 62, could also be used in the present invention, if desired.

Blade carrier 16 includes a hole 60 for receipt of a shoulder 62 of blade carrier pivot 18 in a rearward or, tang, portion, generally 64, of blade carrier 16. Tang 64 includes an extreme end having a curved profile 64*a*, such profile terminating at one end in a lock notch 66. Lock notch 66 functions to receive a locking bolt 68 upon blade carrier 16 being moved to the open position. Once blade carrier 16 arrives at the open position, lock bolt 68 moves generally rectilinearly within a bolt channel 70 in handle 14 to register with lock notch 66. This happens automatically due to the spring force provided by a resilient or biasing means, such as a spring 72, which, in one preferred embodiment, is a coil spring. It is to be understood, however, that other springs, piston/cylinder/hydraulic or pneumatic arrangements, repulsive magnetic arrangements, etc. could be used instead of coil spring 72, if desired. Spring 72 is also carried within bolt channel 70 and urges lock bolt 68 towards tang 64 of blade carrier 16. Lock bolt 68 includes a passage 74, which receives actuator, generally 76, which could be formed in two pieces, namely member 76*a* and member 76*b*. Actuator 76 travels within channels 80 provided in each handle portion 26, 28 and in one preferred embodiment extend outwardly from both sides of handle 14, such that the user can access and actuate lock bolt 68 from either side of handle 14. This provides for ambidextrous use of knife 10 by a user.

As noted above, as blade carrier 16 moves to the open position, lock bolt 68 automatically moves to a locking position to lock blade carrier in the open position. For the user to pivot blade carrier 16 to the closed position, the user would move actuator 76 rearwardly within channel 80 such that the extreme end 68*a* of the lock bar 68 no longer engages with lock notch 66. Upon so doing, blade carrier 16 can be pivoted towards the closed position. In one preferred embodiment, extreme end 68*a* of the lock bar 68 is curved and bears against curved profile 64*a* of tang 64 in a manner to provide some resistance to pivoting of blade carrier 16, such that blade carrier 16 does not simply freefall from the open position towards a closed position in an uncontrolled manner. Instead, preferably, the user will be required to deliberately move blade carrier 16 toward the closed position.

Figure 4:
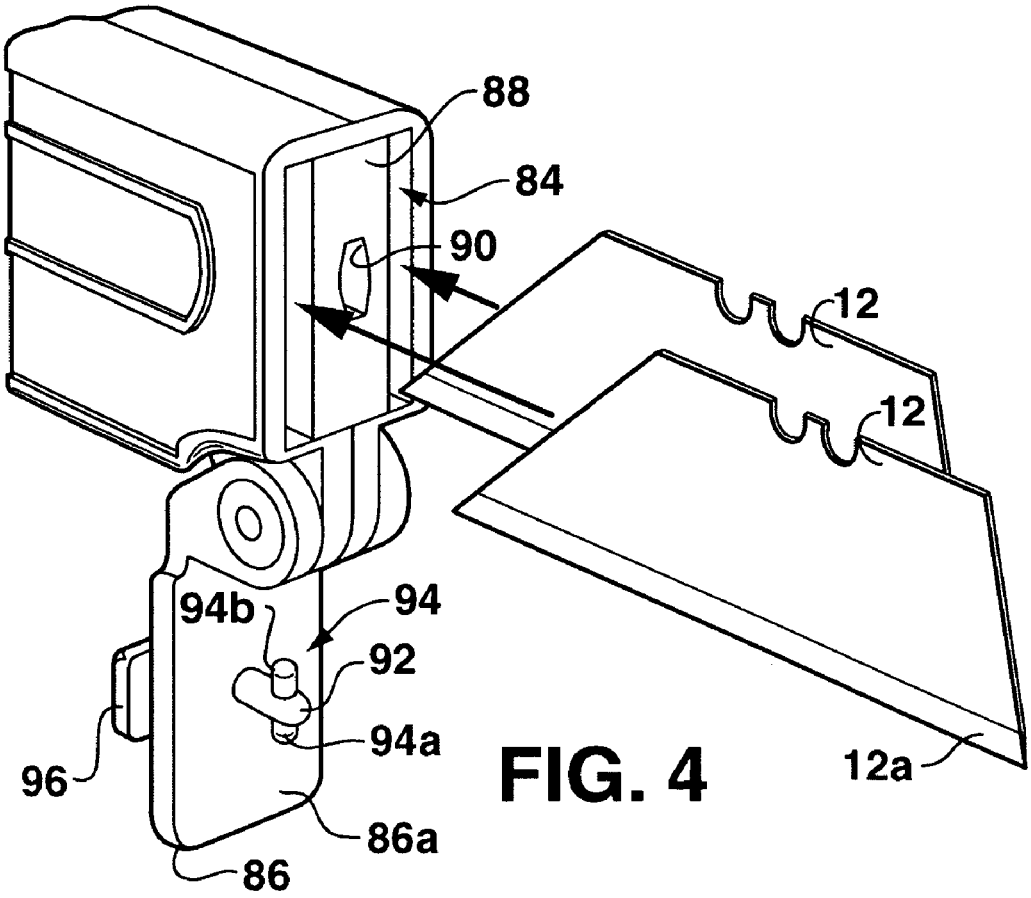
FIG. 4 is a partial perspective view illustrating a blade, or cutting implement, storage compartment in the handle of a folding utility knife constructed in accordance with the present invention.

FIG. 4 illustrates a blade storage compartment, generally 84, for storing additional blades 12. Such place could be new blades, or blades which have already been used. A closure member, or door, 86 is pivotally attached to the end of handle 14 opposite where blade carrier 16 is connected to handle 14. In FIG. 4, door 86 is shown pivoted downwardly from its normally closed position, such closed position being shown in FIGS. 1 through 3. When door 86 is in its closed position, the inner surface 86*a* of door 86 is adjacent a keeper portion 88 which defines a vertically elongated latch opening 90 therein. A rotateable latch member 92 is carried within door 86 and includes a locking profile, generally 94, which as shown in FIG. 4, includes two transversely extending portions 94*a* and 94*b*. Portions 94*a*, 94*b* are configured such that they may pass through opening 90 of keeper portion 88 when arranged in a generally vertical position, with respect to the generally vertically extending opening 90 of keeper 88, and once door 86 is fully closed to contain blade storage 84, a lock actuator 96 can be rotated approximately 90°, which causes portions 94*a*, 94*b*, to be in engagement with the back side 88*a*, FIG. 5, of keeper 88, to thereby lock door 86 in a closed position.

Door 86 includes a yoke portion, generally 100, which cooperates with downwardly extending ears 102 with opening 104 provided on handle 14. A hinge pin 106 is inserted through openings 108 in yoke 100 and openings 104 in ears 102 to effectively hinge door 86 to handle 14.

Storage compartment 84 is configured for holding several blades 12, which can be inserted on either side of keeper panel 88. When it is desired to access blade storage 84, latch actuator 96 is rotated 90°, such that portions 94*a*, 94*b* may pass through opening 90 of keeper panel 88 thereby allowing door 86 to be swung open to its position as shown in FIG. 4.

In use, the user would typically use his or her thumb and/or one or more fingers to move blade carrier 16, and, accordingly, blade 12 therein, from the closed position to the open position by engaging thumb stud/blade fastener combination 46. If desired, however, blade carrier 16 can be withdrawn without using combination 46 if desired. Once moved to the open position, blade carrier 16 is automatically locked in the open position by the advancement of lock bolt 68 into engagement with lock notch 66. If a blade 12 is to be inserted into blade carrier 16, knob 50 is rotated to loosen retainer panel 42 sufficiently to allow blade 12 to be pulled outwardly such that its cutting edge 12*a* clears ledge 36 of blade carrier 16. This allows blade 12 to be withdrawn and a new blade inserted in its place. Knob 50 is then turned to tighten retainer panel 42 against blade 12 to facilitate retention of blade 12 with a receptacle 32.

In one preferred embodiment, knob 50 is allowed to rotate freely to tighten or loosen retainer panel 42, but is captured in member 48 and is thus prevented from being removed from blade carrier 16. This allows panel 42 to be generally permanently maintained with blade carrier 16, although panel 42 is moveable in amount sufficient to allow insertion and removal of blades 12 into blade carrier 16. This prevents panel 42 and/or knob 50 from being dropped, lost, or misplaced.

In an alternate embodiment shown in FIG. 5, a separate screw 100*a* is fixedly received in a knob 48*a* (which may be fixed to blade carrier 16), and a knob 50*a* is threadingly engaged to screw 100*a*, and may move to and fro on the threaded shaft 112 of screw 100*a*, but is prevented, as is also panel 42, from being removed from knife 10 by screw head 114 of screw 100*a*.

In order to move blade carrier 16 to the closed position within blade cavity 116 of handle 14, the user would pull rearwardly on one or more slide buttons 76*a*, 76*b* a sufficient distance such that the extreme end 68*a* of lock bolt 68 clears lock notch 66 on tang 64 of blade carrier 16. The user would then begin pivoting of blade carrier 16 from the open position toward the closed position. At the point lock bolt 68 no longer registers with lock notch 66, the user could release slides 76*a*, 76*b* such that the forward end 68*a* of lock bolt 68 bears against the curved profile 64*a* of tang 64 to provide some resistance in movement of blade carrier 16 from the opened to the closed position.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A utility knife, comprising:

a handle having a first exterior side and a second exterior side generally opposite said first exterior side;

a blade carrier pivotally connected to said handle for pivoting between a retracted position generally adjacent said handle and an extended position extending generally outwardly from said handle;

a blade carried in said blade carrier;

said blade carrier defining a receptacle configured for readily removable receipt of said blade;

a blade retainer generally opposite said receptacle and configured for extending adjacent said blade and for retaining said blade in said receptacle;

a threaded fastener for selectively fastening said blade retainer to said blade carrier;

said threaded fastener configured, upon a user holding said handle in the user's hand, for engagement by at least one of the digits of the user's hand to move said blade carrier between said retracted position and said extended position;

a locking member carried by said handle for movement between a locking position and an unlocking position, said locking member being configured for automatically moving to said locking position for locking said blade carrier in said extended position upon said blade carrier being moved to said extended position;

a spring configured for forcing said locking member towards said locking position;

an actuator connected to said locking member configured for moving said locking member against the force of said spring to said unlocking position, said actuator extending outwardly from said first exterior side of said handle and said second exterior side of said handle;

said handle defining a storage compartment configured for receipt of at least one blade;

a closure member configured for retaining said at least one blade in said storage compartment; and said closure member being movable to allow selective access to said at least one blade in said storage compartment.

2. The utility knife as defined in claim 1, wherein said threaded fastener is fixed from removal from said blade carrier.

3. The utility knife as defined in claim 1, further comprising:

a hinge connecting said closure member to said handle, said hinge being configured for allowing pivotal movement of said closure member with respect to said handle.

4. The utility knife as defined in claim 1, further comprising:

a lock carried by said closure member, said lock being configured to pivot to a locking position for selectively locking said closure member to said handle.

5. A utility knife for receipt of a blade, comprising:

a handle;

a blade carrier pivotally connected to said handle for pivoting between a retracted position generally adjacent said handle and an extended position extending generally outwardly from said handle;

said blade carrier defining a receptacle configured for readily removable receipt of the blade;

a blade retainer configured for extending adjacent the blade and for retaining the blade in said receptacle;

a threaded fastener for selectively fastening said blade retainer to the blade carrier;

said threaded fastener configured, upon a user holding said handle in the user's hand, for engagement by at least one of the digits of the user's hand to move said blade carrier between said retracted position and said extended position;

a locking member carried by said handle for movement between a locking position and an unlocking position, said locking member being configured for automatically moving to said locking position for locking said blade carrier in said extended position upon said blade carrier being moved to said extended position;

said handle defining a storage compartment configured for receipt of at least one blade;

a closure member configured for retaining said at least one blade in said storage compartment; and said closure member being movable to allow selective access to said at least one blade in said storage compartment.

6. A utility knife for receipt of a blade, comprising:

a handle having a first exterior side and a second exterior side generally opposite said first exterior side;

a blade carrier pivotally connected to said handle for pivoting between a retracted position generally adjacent said handle and an extended position extending generally outwardly from said handle;

said blade carrier defining a receptacle configured for readily removable receipt of the blade;

a blade retainer configured for extending adjacent the blade and for retaining the blade in said receptacle;

a threaded fastener for selectively fastening said blade retainer to said blade carrier;

said threaded fastener configured, upon a user holding said handle in the user's hand, for engagement by at least one of the digits of the user's hand to move said blade carrier between said retracted position and said extended position;

a locking member carried by said handle for movement between a locking position and an unlocking position, said locking member being configured for automatically moving to said locking position for locking said blade carrier in said extended position upon said blade carrier being moved to said extended position;

a spring configured for forcing said locking member towards said locking position; and an actuator connected to said locking member configured for moving said locking member against the force of said spring to said unlocking position, said actuator extending from said first exterior side of said handle to said second exterior side of said handle.

7. A utility knife for receipt of a blade, comprising:

a handle having a first exterior side and a second exterior side generally opposite said first exterior side;

a blade carrier pivotally connected to said handle for pivoting between a retracted position generally adjacent said handle and an extended position extending generally outwardly from said handle;

said blade carrier defining a receptacle configured for readily removable receipt of the blade;

a blade retainer configured for extending adjacent the blade and for retaining the blade in said receptacle;

a threaded fastener for selectively fastening said blade retainer to said blade carrier;

said threaded fastener configured, upon a user holding said handle in the user's hand, for engagement by at least one of the digits of the user's hand to move said blade carrier between said retracted position and said extended position;

said threaded fastener being fixed from removal from said blade carrier;

a locking member carried by said handle for movement between a locking position and an unlocking position, said locking member being configured for automatically moving to said locking position for locking said blade carrier in said extended position upon said blade carrier being moved to said extended position;

a spring configured for forcing said locking member towards said locking position;

an actuator connected to said locking member configured for moving said locking member against the force of said spring to said unlocking position, said actuator extending from said first exterior side of said handle to said second exterior side of said handle; and said handle defining a storage compartment configured for receipt of at least one blade.

8. The utility knife as defined in claim 7, further comprising:

a closure member configured for retaining said at least one blade in said storage compartment; and said closure member being movable to allow selective access to said at least one blade in said storage compartment.

9. The utility knife as defined in claim 7, further comprising:

a closure member configured for retaining said at least one blade in said storage compartment, said closure member being configured to allow selective access to said at least one blade in said storage compartment; and a hinge connecting said closure member to said handle, said hinge being configured for allowing pivotal movement of said closure member with respect to said handle.

10. The utility knife as defined in claim 7, further comprising:

a closure member configured for retaining said at least one blade in said storage compartment;

a hinge connecting said closure member to said handle, said hinge being configured for allowing pivotal movement of said closure member with respect to said handle; and a lock carried by said closure member, said lock being configured to pivot to a locking position for locking said closure member to said handle.

11. A utility knife for receipt of a blade, comprising:

a handle having a first exterior side and a second exterior side generally opposite said first exterior side;

a blade carrier pivotally connected to said handle for pivoting between a retracted position generally adjacent said handle and an extended position extending generally outwardly from said handle;

said blade carrier defining a receptacle configured for readily removable receipt of the blade;

a blade retainer configured for extending adjacent the blade and for retaining the blade in said receptacle;

a locking member carried by said handle for movement between a locking position and an unlocking position, said locking member being configured for automatically moving to said locking position for locking said blade carrier in said extended position upon said blade carrier being moved to said extended position;

an actuator connected to said locking member configured for moving said locking member to said unlocking position, said actuator extending from said first exterior side of said handle to said second exterior side of said handle;

said handle defining a storage compartment configured for receipt of at least one blade; and a closure member configured for retaining said at least one blade in said storage compartment; and said closure member being movable to allow selective access to said at least one blade in said storage compartment.

12. A utility knife for receipt of a blade, comprising:

a handle having a first exterior side and a second exterior side generally opposite said first exterior side;

a blade carrier pivotally connected to said handle for pivoting between a retracted position generally adjacent said handle and an extended position extending generally outwardly from said handle, said blade carrier defining a first side and a second side generally opposite said first side;

said blade carrier defining a receptacle configured for readily removable receipt of the blade;

a fastener for selectively fastening the blade to said blade carrier;

said fastener projecting outwardly from said first side and said second side of said blade carrier and being configured, upon a user holding said handle in the user's hand, for engagement by at least one of the digits of the user's hand to move said blade carrier between said retracted position and said extended position;

a locking member carried by said handle for movement between a locking position and an unlocking position, said locking member being configured for automatically moving to said locking position for locking said blade carrier in said extended position upon said blade carrier being moved to said extended position;

a spring configured for forcing said locking member towards said locking position;

an actuator connected to said locking member configured for moving said locking member against the force of said spring to said unlocking position, said actuator extending from said first exterior side of said handle to said second exterior side of said handle;

said handle defining a storage compartment configured for receipt of at least one blade;

a closure member configured for retaining said at least one blade in said storage compartment; and said closure member being movable to allow selective access to said at least one blade in said storage compartment.

13. The utility knife as defined in claim 12, further comprising:

a blade retainer panel interposed between said blade and said fastener and configured for retaining said blade in said receptacle, said blade retainer panel being fixed from removal from said blade carrier.

14. A utility knife for receipt of a blade, comprising:

a handle;

a blade carrier pivotally connected to said handle for pivoting between a retracted position adjacent said handle and an extended position extending generally outwardly from said handle, said blade carrier defining a first side and a second side generally opposite said first side;

said blade carrier defining a receptacle configured for readily removable receipt of the blade;

a blade retainer configured for extending adjacent said blade and for retaining said blade in said receptacle;

a threaded fastener for selectively fastening said blade retainer to said blade carrier;

said threaded fastener being fixed from removal from said blade carrier; and said fastener projecting outwardly from said first side and said second side of said blade carrier and being configured, upon a user holding said handle in the user's hand, for engagement by at least one of the digits of the user's hand to move said blade carrier between said retracted position and said extended position.

* * * * *